US005542580A

United States Patent [19]

Hatakeyama et al.

[11] Patent Number: 5,542,580

[45] Date of Patent: Aug. 6, 1996

[54] TUBE CONTAINER

[75] Inventors: Yoshiharu Hatakeyama, Tokyo; Hiroki Fukuoka, Misato; Kenzo Teshima, Chiba, all of Japan

[73] Assignee: Yoshida Industry Co., Ltd., Tokyo, Japan

[21] Appl. No.: 457,819

[22] Filed: Jun. 1, 1995

[30] Foreign Application Priority Data

Jun. 28, 1994 [JP] Japan ..... 6-146023

[51] Int. Cl.[6] ..... B67D 5/06

[52] U.S. Cl. ..... 222/183; 222/321.7

[58] Field of Search ..... 222/95, 105, 106, 222/162, 183, 209, 212, 321.6, 321.7, 321.9, 378, 381, 386.5, 387, 383.1

[56] References Cited

U.S. PATENT DOCUMENTS

| | | | |
|---|---|---|---|
| 3,876,115 | 4/1975 | Venus, Jr. et al. | 222/386.5 |
| 3,936,334 | 2/1976 | Kushida et al. | 222/95 |
| 4,008,830 | 2/1977 | Meshberg | 222/95 |
| 5,388,727 | 2/1995 | Jovillat | 222/105 |

FOREIGN PATENT DOCUMENTS

| | | |
|---|---|---|
| 58-193261 | 11/1983 | Japan . |
| 59-51746 | 4/1984 | Japan . |
| 3-17059 | 2/1991 | Japan . |

*Primary Examiner*—Andres Kashnikow
*Assistant Examiner*—Philippe Derakshani
*Attorney, Agent, or Firm*—Wenderoth, Lind & Ponack

[57] ABSTRACT

A tube includes inner and outer sleeves that can be sealed simultaneously. The inner sleeve is supported in the outer sleeve stably while deformation of the inner sleeve is allowed due to discharge of contents therein. The outer sleeve encloses the inner sleeve to define a space therebetween. A dispenser for discharging the contents out of the inner sleeve includes a cylinder through which the contents is delivered. The dispenser is mounted to the outer sleeve and the cylinder is slidably related to the inner sleeve. Bottom ends of the inner sleeve and the outer sleeve are adhered to each other to define a bottom portion of the inner sleeve. The outer sleeve has at least one passage communicating the space with the outside of the outer sleeve.

9 Claims, 7 Drawing Sheets

TUBE CONTAINER

BACKGROUND ART

1. Field of the Invention

The present invention relates generally to a tube container, and more particularly relates to a tube container having an inner sleeve for containing a substance therein, an outer sleeve enclosing the inner sleeve, and a dispenser for discharging the substance from the inner sleeve.

2. Description of the Related Art

One example of a tube container of this kind, which has a dispenser attached to a tube body thereof, has been disclosed in Japanese Unexamined Utility Model Publication (Kokai) No. 3-17059. The disclosed tube container includes a tube body made of elastic material, which is gradually flattened along with the dispensing of the substance, and a dispenser coupled with a mouth portion of the tube body. The substance in the inner sleeve can be discharged by pushing and releasing a spout of the dispenser. The tube body tends to become flattened gradually as the contents is being discharged.

The tube container with a dispenser of this type has eliminated awkward operation by users, i.e., adjustment of a pressing force to be applied to the spout manually, because a certain amount of the contained substance can be discharged by simply pushing down the spout. Also, no substance is left remaining at the mouth portion and shoulder portion in the tube body after the contents is used up, because the contents can be almost completely discharged by a pump of the dispenser. Thus, the tube container so constructed is economical. Furthermore, since air does not come into the tube body during use, no oxidization of the contents or entry of undesirable microorganisms in the air will occur until the end of the usage of the tube container. Therefore, the users can use the container comfortably until emptied.

The tube container disclosed in the above publication, however, may have the following shortcomings. Firstly, the appearance may deteriorate during use because the tube body becomes flattened during discharge of the contents. Secondly, the commercial value of the tube body may be lessened since decorations applied onto the outer periphery of the tube body by printing, hot stamping and so forth become deformed by the aforementioned flattening of the tube body. Thirdly, it may become inconvenient for users to hold in hand, to place somewhere, or to operate the dispenser due to the flattening of the tube body.

In order to overcome the above-mentioned possible deficiencies and to maintain the initial shape of the tube container, one solution may be to employ the constitutions disclosed in Japanese Unexamined Utility Model Publication (Kokai) No. 59-51746 or Japanese Unexamined Patent Publication (Kokai) No. 58-193261. The tube container disclosed in the former document has a tube body with a laminated structure in which an outer sleeve and a soft inner sleeve holding contents therein are coupled at the mouth portion of the tube body. The bottom portion of each sleeve is sealed separately. In the outer sleeve, an opening is formed so as to communicate the inside of the outer sleeve with the outer air.

On the other hand, the tube container disclosed in the latter document is so constructed to have a double structure in which an inner sleeve made of an unrecoverable elastic member and an outer sleeve made of a recoverable elastic member are coupled at the mouth portion of the container.

The bottom portion of each sleeve is sealed separately. An opening is formed through the outer sleeve.

With these tube containers, because only the inner tube is deformed along with the discharge of the contents, whereas the outer sleeve can maintain its initial shape due to entry of the air from the outside through the openings in the outer sleeve, the tube container as a whole can maintain its initial appearance. Therefore, deformation of decorations which are applied on the outer periphery of the tube body by printing, hot stamping, and so forth will not occur. Also, inconvenience in holding or handling the tube body is avoided, and placement of the container is facilitated.

However, considering application of the structures of the aforementioned conventional tube containers to other tube containers with a dispenser, there might be a problem that the inner sleeve may not be held stably in the outer sleeve because the bottom portions of both the outer sleeve and the inner sleeve are sealed separately and the inner sleeve is simply supported at the mouth portion of the container. It has been believed to be difficult to solve this problem, considering that the inner sleeve becomes flattened and shortened during use and discharge of the contents.

Moreover, with regard to manufacturing the tube containers of above described structures, it may be another problem that the manufacturing process thereof would be complicated because the bottom portions of the outer and the inner sleeve should be sealed in separate manufacturing steps.

SUMMARY OF THE INVENTION

In view of the drawbacks in the related art, it is an object of the present invention to provide a tube container in which an inner sleeve and an outer sleeve can be sealed simultaneously and the inner sleeve can be supported in the outer sleeve stably while allowing deformation of the inner sleeve due to discharge of the contents therein.

Another object of the present invention is to provide a tube container in which an outer sleeve can maintained its initial shape while an inner sleeve is deformed.

In order to accomplish the above-mentioned and other objects, a tube container, according to one aspect of the invention, comprises means for storing fluidized substance therein, means for enclosing the storing means so as to define a space therebetween, and means for discharging the fluidized substance out of the storing means, having a projecting hollow portion through which the fluidized substance is delivered. The discharging means is mounted to the enclosing means and is slidably related to one end of the storing means with the projecting hollow portion. Other ends of the storing means and the enclosing means are adhered to each other to define a bottom portion of the storing means, and the enclosing means comprises at least one passage communicating the space with the outside of the enclosing means.

The storing means may be formed of elastic material and the enclosing means may include a shoulder portion in which the passage is disposed. The discharging means may also comprise a check valve in order to prevent entering of air into the storing means.

According to another aspect of the present invention, a tube container comprises a tube body formed by an inner sleeve of elastic material for containing fluidized substance therein, and an outer sleeve enclosing the inner sleeve and defining a space therebetween, the inner and outer sleeves being sealed at one end thereof to form a bottom portion of the tube body, a dispenser assembly for discharging the fluidized substance, the dispenser assembly including a stored substance supplying portion slidably inserted into the inner sleeve at the opposite end to the bottom portion thereof, wherein at least one passage is disposed in the outer sleeve to communicate the space between the inner and the outer sleeves with the outside of the outer sleeve.

The inner sleeve may be formed of elastic material and the outer sleeve may include a shoulder portion in which the passage is disposed.

The dispenser assembly may also comprise a check valve in order to prevent entering of air into the inner sleeve.

According to yet another aspect of the present invention, a manufacturing process of the tube container of the present invention comprises the steps of mounting a discharging means on one end of an enclosing means, connecting a lower projecting portion of the discharging means with a storing means so as to allow communication between an inner space of the storing means and the outside thereof, adhering the storing means and the enclosing means to each other at the other ends thereof so as to form a closed bottom portion of the tube container, and cutting an extra extending portion away from the bottom portion of the tube container to obtain a finished product.

In the preferred construction, the adhering step in the manufacturing process may be performed by ultrasonic welding.

In according with the tube container of the present invention, the outer sleeve of the tube body can maintain its initial shape while the inner sleeve becomes flattened. Thus, deterioration of the appearance of the tube body can be avoided. In the meantime, deformation of decorations applied on the outer periphery of the tube body by printing, hot stamping, and so forth will not occur. Inconvenience in holding or handling the tube body is avoided, and placement of the container is facilitated.

Furthermore, according to the present invention, the inner sleeve is held stably in the outer sleeve when the inner sleeve becomes flattened and shortened during use with discharge of the contents.

Moreover, in accordance with the manufacturing process of the tube container of the present invention, the manufacturing cost will be reduced by simplification of the process thereof, in which the bottom portions of the inner and the outer sleeves are simultaneously sealed.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing form the invention. Accordingly, the drawings and description are to be regarded as illustrative in nature, and not as restrictive.

DESCRIPTION OF PREFERRED EMBODIMENT AND BEST MODE FOR CARRYING OUT THE INVENTION

Figure 1:
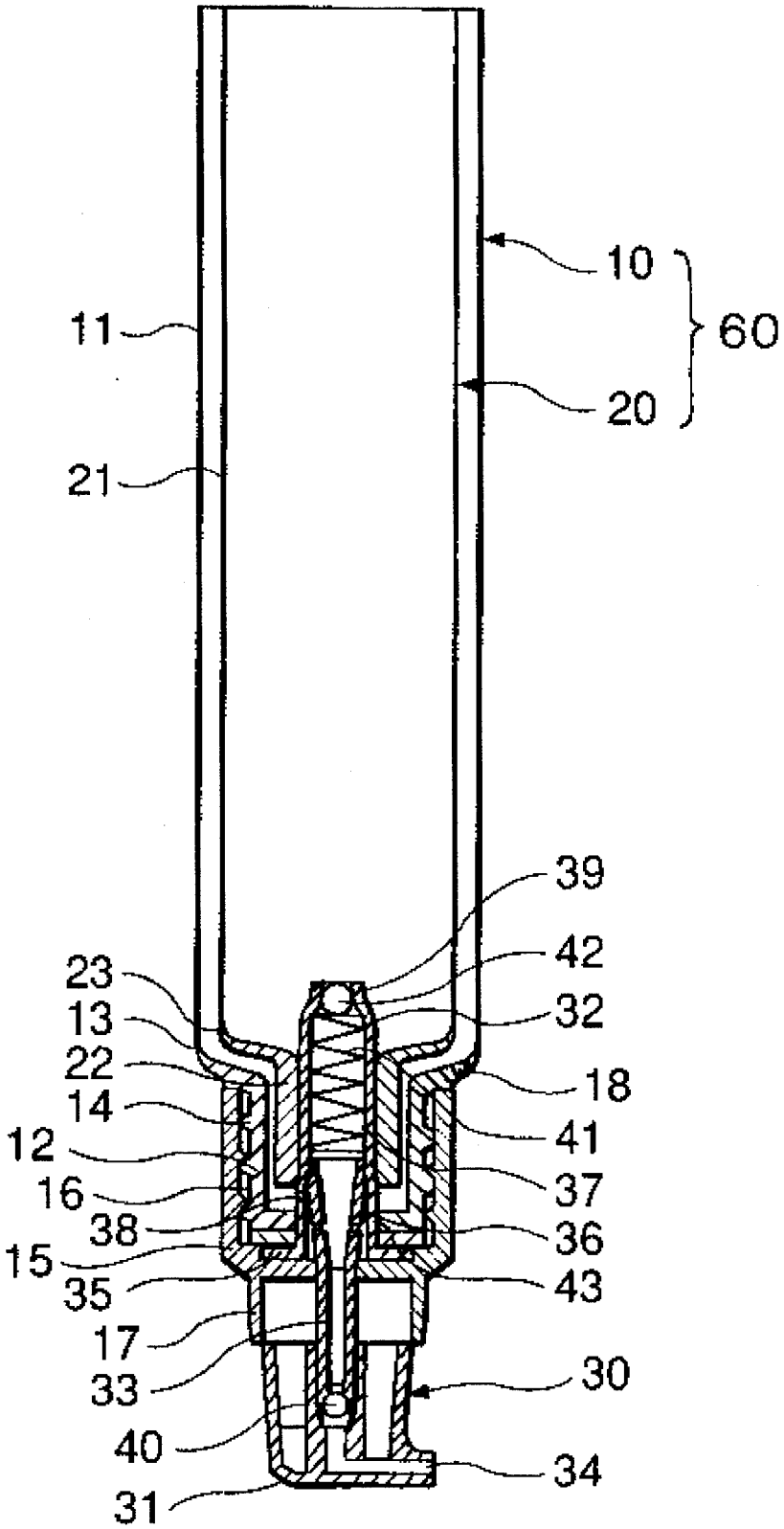
FIG. 1 is a section of a tube container according to one embodiment of the present invention before sealing of the bottom portion of the tube body thereof.
Figure 2:
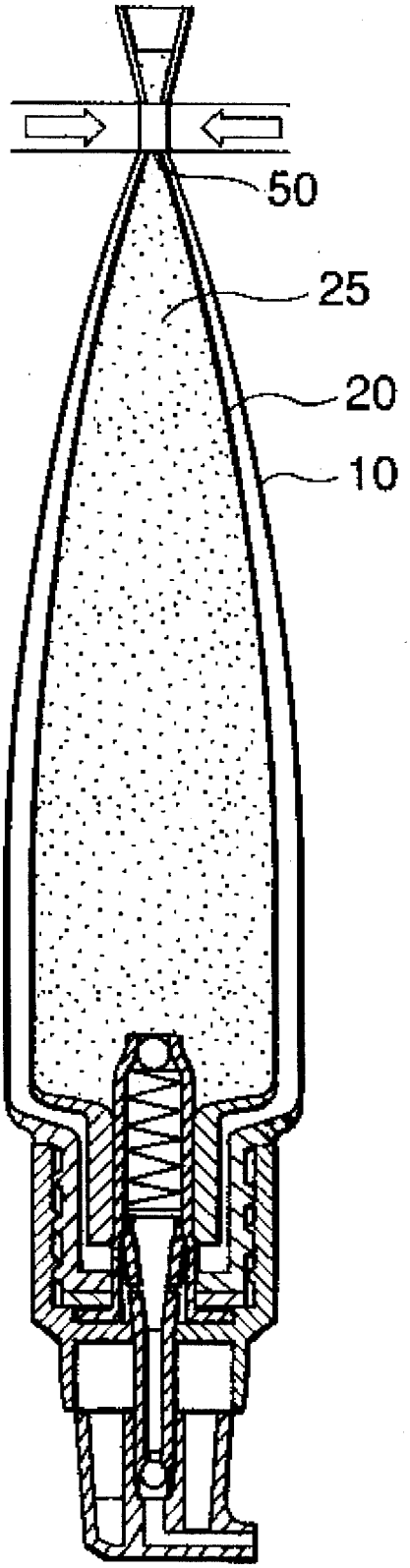
FIG. 2 is a section of the tube container being pressed for sealing of the bottom portion of the tube body thereof.
Figure 3:
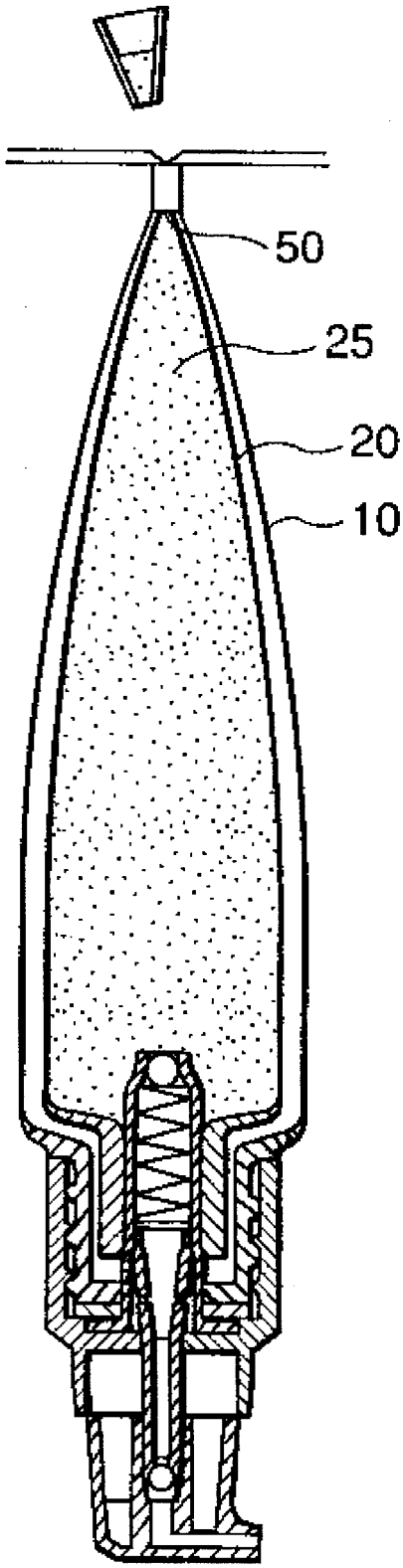
FIG. 3 is a section of the tube container being trimmed at the bottom end portion of the tube body thereof after sealing.

The preferred embodiment of the present invention will be discussed herebelow with reference to the accompanying drawings. FIGS. 1 through 3 show a structure and a manufacturing process of the tube container according to the present invention. The tube container of the invention comprises an outer sleeve 10, an inner sleeve 20 and a dispenser 30. The inner sleeve 20 corresponds to a means for storing fluidized substance therein, while the outer sleeve 10 and the dispenser 30 are a means for enclosing the inner sleeve 20 and a means for discharging the fluidized substance, respectively. FIG. 1 shows a section of the tube container of the preferred embodiment of the invention before sealing of a bottom portion 50 of the tube container. Basically, the tube container of this embodiment includes the inner sleeve 20 made of elastic material, filled with contents 25 and the outer sleeve 10 enclosing the inner sleeve 20. Adjacent ends of the sleeves 10 and 20 are integrally joined and sealed to form a tube body 60. A cylinder 32 as a projecting hollow portion for discharging the contents is disposed at an opposite end of the tube 60 by being fixed to the other end of the outer sleeve 10. The cylinder 32, which is engaged with the other end of the inner sleeve 20 slidably, is disposed in the dispenser 30. An air passage 18 as an opening is provided through the outer sleeve 10 and communicates the space defined between the outer sleeve 10 and the inner sleeve 20 with the outside of the tube body 60.

The outer sleeve 10 is formed of elastic material and includes a cylindrical body portion 11, a neck portion 12, a diameter of which is a little smaller than that of the body portion 11, and a shoulder portion 13 coupling the body portion 11 with the neck portion 12 integrally. On the outer periphery of the neck portion 12 is formed a male screw 14. An opening is formed through the upper center portion of the neck portion 12. The neck portion 12 is sealed with a cap 15 of the dispenser 30. On the inner peripheral surface of the cap 15 is formed a female screw 16 which can be engaged with the male screw 14 formed on the neck portion 12 of the outer sleeve 10. An upright wall 17 is disposed around the upper peripheral portion of the cap 15. Air passage 18 extends through the shoulder portion 13. It should be noted that the outer sleeve 10 may be formed of material without elasticity.

The inner sleeve 20 also is formed of elastic material and comprises a cylindrical body portion 21 having an opening bottom portion 50, a neck portion 22, a diameter of which is a little smaller than that of the body portion 21, and a shoulder portion 23 coupling the body portion 21 with the neck portion 22 integrally. The upper surface of the neck portion 22 remains open. In this embodiment of the invention, the inner sleeve 20 has a diameter smaller than that of the outer sleeve 10 by seven (7) to ten (10) millimeters. The height of the neck portion 22 is shorter than that of the neck portion 12 of the outer sleeve 10.

The dispenser 30 has a known structure, including a spout 31, the cylinder 32 and a piston 33. The spout 31 is slidably inserted into the upright wall 17 of the cap 15. There is formed a nozzle 34 through the upper peripheral portion of the spout 31. The cylinder 32 as a cylindrical contents discharging portion projects downwardly from the opening of the cap 15. An upper end portion of cylinder 32 constitutes a flange portion 35 extending outwardly in a radial direction. The outer diameter of an upper portion 36 of the cylinder 32 is almost equal to the inner diameter of the upper opening of the neck portion 12 of the outer sleeve 10, whereas the outer diameter of a lower portion 37 is almost equal to the inner diameter of the neck portion 22 of the inner sleeve 20. An air passage 38 is formed in the peripheral wall of the upper portion 36 so as to secure smooth movement of the piston 33 in the dispenser 30. Furthermore, the diameter of a lower end portion 39 of the cylinder 32 is smaller than that of the lower portion 37. The piston 33 is inserted into the lower end portion of the nozzle 34 of the spout 31 to extend downwardly into the cylinder 32 in a slidable manner. At the upper end portion of the piston 33 there provided a ball valve 40. Another ball valve 42 is disposed at the lower end portion 39, beneath the piston 33 and below a coil spring 41. The ball valve 42 is allowed to move along the inside of the cylinder 32.

The cap 15 of the dispenser 30 is screwed onto the neck portion 12 of the outer sleeve 10 of the above constitution, and the cylinder 32 is inserted into the opening formed in the outer sleeve 10. Between the lower surface of the cap 15 and the upper surface of the neck portion 12 of the outer sleeve 10 is disposed a packing 43. The inner periphery of the neck portion 22 of the inner sleeve 20 is in contact with the outer periphery of the lower portion 37 of the cylinder 32 in a downwardly slidable manner.

FIG. 2 shows a step of pressing the bottom portion 50 of the above described tube container for sealing. The inner sleeve 20 is filled with the contents 25, then the bottom portion 50 of the outer sleeve 10 and the inner sleeve 20 are clamped with an ultrasonic hone to be sealed in liquid. As shown in FIG. 3, the tube container is finished by trimming of an extra tip portion beyond the sealed portion. The manufacturing process of filling of the tube body and sealing of the bottom portion of the same according to the present invention can be performed in typical conventional steps by using typical conventional devices.

Figure 4:
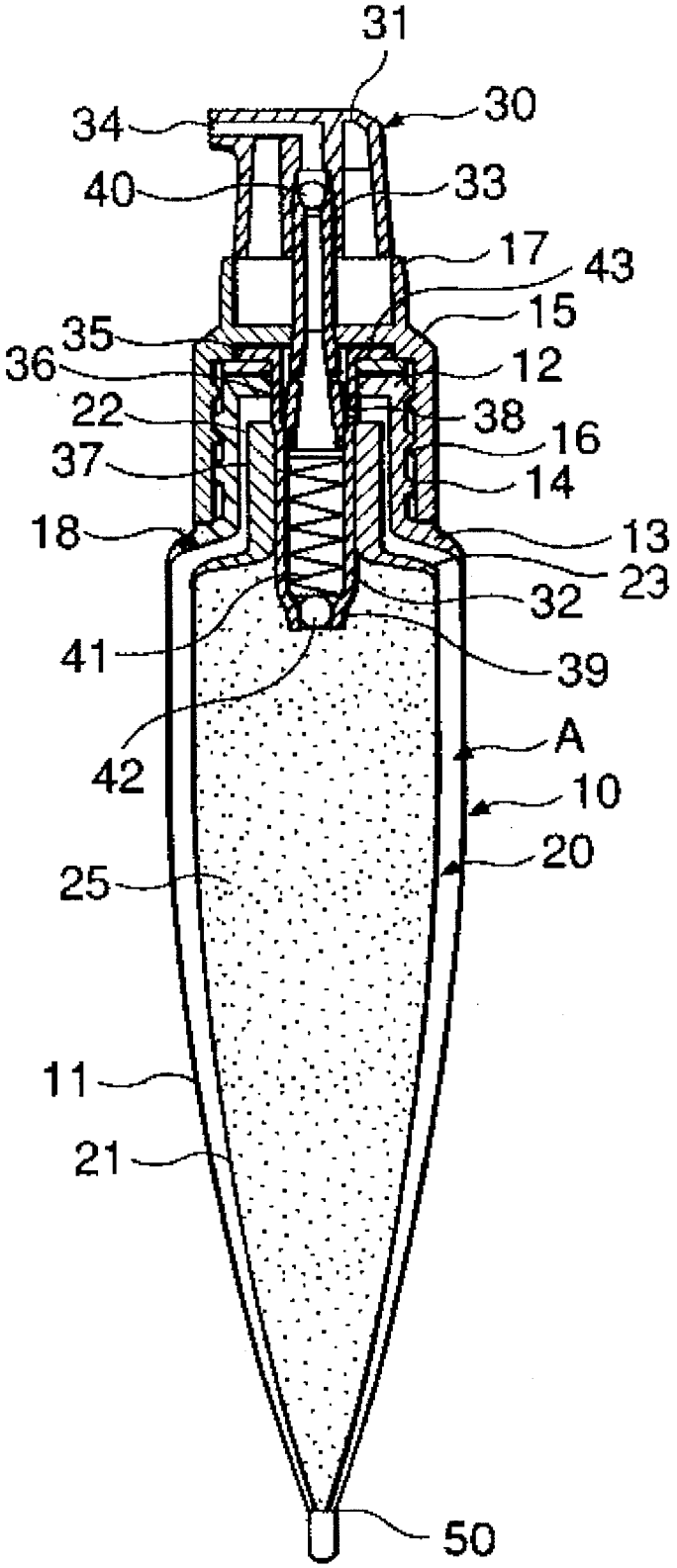
FIG. 4 is a section of the finished tube container.

FIG. 4 is a section of the tube container with a dispenser according to the invention, in which the inner sleeve 20 is filled with the contents 25. As shown in FIG. 4, the inner sleeve 20 is closed with the cylinder 32 fitting therein, and a predetermined amount of the contents 25 is stored in the lower portion 37 of the cylinder 32. The inner sleeve 20 is supported almost at the center in a space A defined by the outer sleeve 10. The space A communicates with the air passage 18 provided at the shoulder portion 13 of the outer sleeve 10. Thereby, outside air can pass into and out of the space A.

Figure 5:
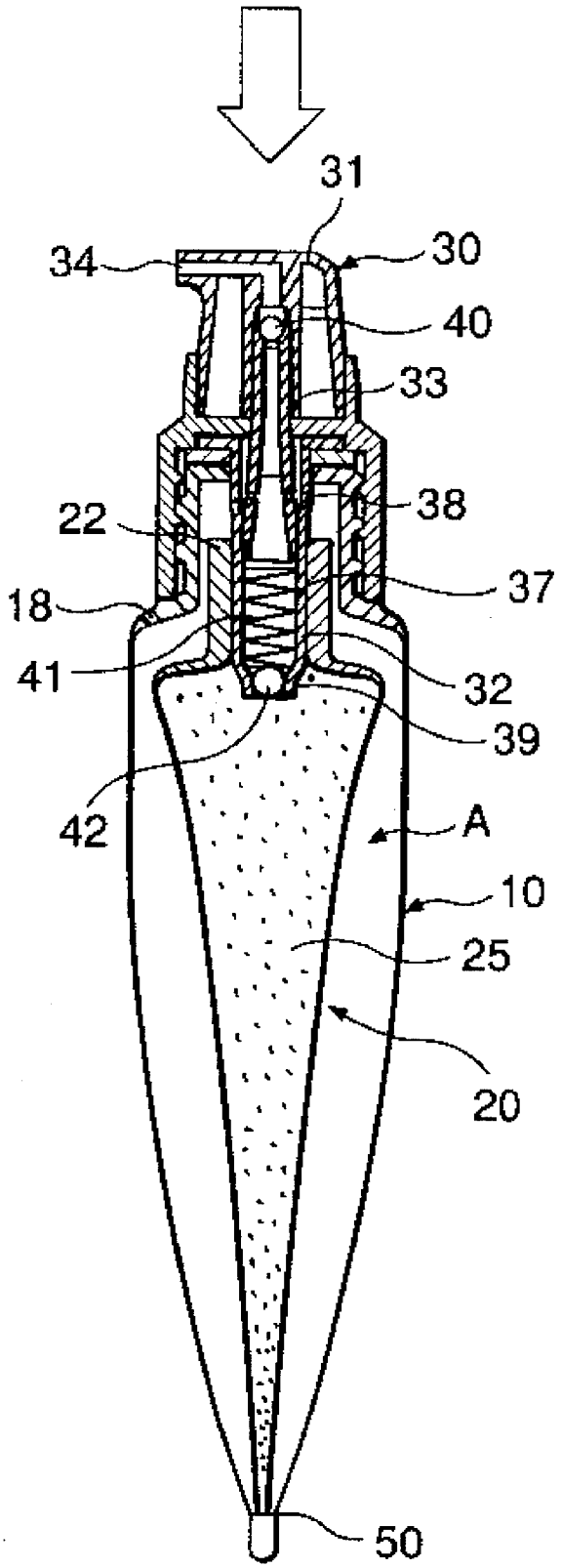
FIG. 5 is a section of the tube container with a spout being pushed down.
Figure 6:
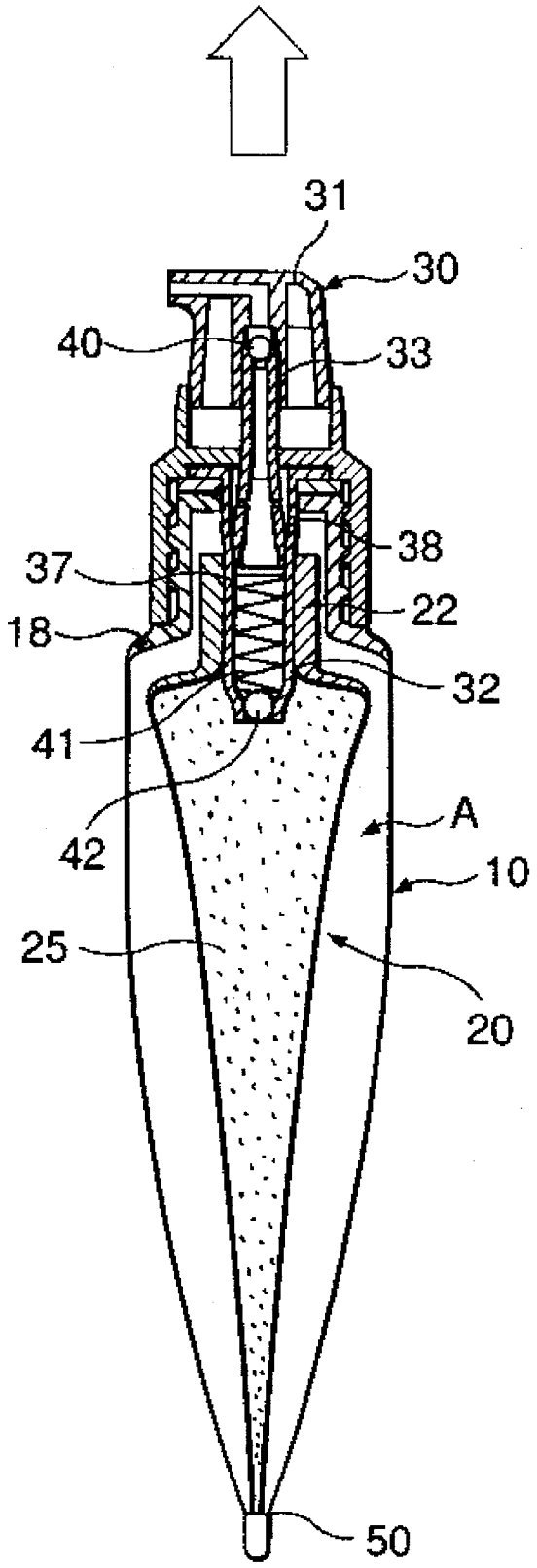
FIG. 6 is a section of the tube container with the spout released.

When the spout 31 of the dispenser 30 is pressed down, as shown in FIG. 5, the coil spring 41 is compressed as the piston 33 moves downwardly. Then the ball valve 40 opens to discharge a given amount of the contents 25 from the nozzle 34. When the spout 31 of the dispenser 30 is released (FIG. 6), the coil spring 41 pushes up the piston 33 to close the ball valve 40. The ball valve 42 is opened to fill the lower portion 37 of the piston 33 with a certain amount of the contents 25.

As discussed thus far, during discharging of the contents 25 by repeating pressing and releasing of the spout 31 of the dispenser 30, the inner sleeve 20 gradually becomes flattened due to decrease of the contents 25 stored therein. In this process of usage of the tube container of the invention, there will not be any possibility of oxidization of the contents 25 or contamination of the contents 25 by entrance of microorganisms from the atmosphere because no outside air will be introduced into the inner sleeve 20.

The inner sleeve 20 becomes shortened while becoming flat. However, the neck portion 22 of the inner sleeve 20 is allowed to slide downwardly upon the shortening of the inner sleeve 20 due to slidable engagement with the outer periphery of the lower portion 37 of the cylinder 32, because the respective bottom portions 50 of the outer sleeve 10 and the inner sleeve 20 are sealed integrally. Therefore, the outer sleeve 10, which is free from deformation, can hold the inner sleeve 20 stably therein while the inner sleeve 20 is allowed to deform. Furthermore, outside air can pass into and out of the space A in the outer sleeve 10 through the air passage 18 provided at the shoulder portion 13 of the outer sleeve 10. The outer sleeve 10 is able to maintain the initial shape and appearance without being affected by deformation of the inner sleeve 20 supported therein.

Figure 7:
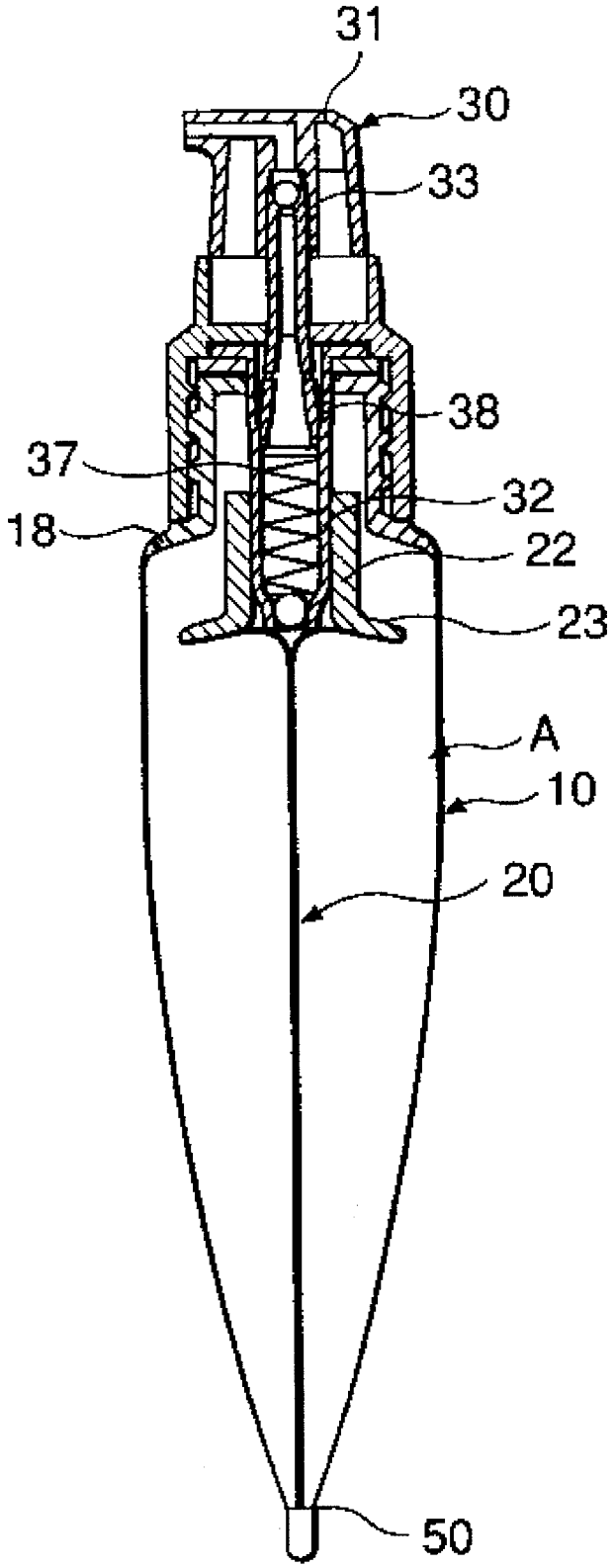
FIG. 7 is a section of the tube container wherein contents are fully discharged and a neck portion has been caused to slide due to deformation of an inner sleeve.

FIG. 7 shows the tube container of the present invention when the contents 25 is completely discharged therefrom. The body portion 21 of the inner sleeve 20 is completely pressed flat, and the upper portion thereof is folded inwardly to fit against the inner surface of the shoulder portion 23. Thereby, the inner sleeve 20 is further shortened. The neck portion 22 of the inner sleeve 20 slidably engaged with the outer periphery of the lower portion 37 of the cylinder 32 moves downwardly while being kept in close contact with the lower portion 37. Since the space A in the outer sleeve 10 is in communication with the outside via the air passage 18 and air is interchanged between the space A and the outside of the outer sleeve 10, the outer sleeve 10 is able to maintain its initial shape without being affected by the deformation of the inner sleeve 20. Therefore, the outward appearance of the tube body is maintained and decorations such as prints and hot stamps applied on the outer peripheral surface of the outer sleeve 10 will not be deformed. In the meantime, possible problems during usage, for example, difficulty in handling, operating and placing, do not arise.

While the present invention has been discussed in terms of the preferred embodiment, the present invention may be implemented in various fashions with modifications of the disclosed embodiment and with omission or modification of the detailed construction, without departing from the principle of the invention. Therefore, the present invention should be understood to include all embodiments encompassed within the spirit of the invention set out in the appended claims.

What is claimed is:

1. A tube container, comprising:

means for storing fluidized substance therein;

means for enclosing said storing means so as to define a space therebetween; and means for discharging the fluidized substance out of said storing means, having a projecting hollow portion through which the fluidized substance is delivered, said discharging means being mounted to said enclosing means and slidably related to one end of said storing means with said projecting hollow portion, wherein other ends of said storing means and said enclosing means are adhered to each other to define a bottom portion of said storing means.

2. A tube container as set forth in claim 1, wherein said enclosing means further comprises at least one passage communicating said space with the outside of said enclosing means.

3. A tube container as set forth in claim 1, wherein said storing means is formed of elastic material.

4. A tube container as set forth in claim 2, wherein said enclosing means includes a shoulder portion in which said passage is disposed.

5. A tube container as set forth in claim 1, wherein said projecting hollow portion of said discharging means comprises a check valve therein,-in order to prevent entering of air into said storing means.

6. A tube container, comprising:

a tube body including an inner sleeve formed of elastic material for containing fluidized substance therein and an outer sleeve enclosing said inner sleeve to define a space therebetween, said inner and outer sleeves being sealed at one ends thereof to form a bottom portion of said tube body; and a dispenser assembly for discharging the fluidized substance out of said inner sleeve, said dispenser assembly being fixed to another end of said outer sleeve, said dispenser assembly including a hollow cylinder inserted into said inner sleeve at another end thereof, wherein said hollow cylinder is slidably engaged with said inner sleeve.

7. A tube container as set forth in claim 6, wherein said outer sleeve further comprises at least one passage communicating said space with the outside of said outer sleeve.

8. A tube container as set forth in claim 7, wherein said outer sleeve includes a shoulder portion in which said passage is disposed.

9. A tube container as set forth in claim 6, wherein said hollow cylinder of said dispenser assembly comprises a check valve therein, in order to prevent entering of air into said inner sleeve.

* * * * *